US009468829B2

(12) United States Patent
Jarvis

(10) Patent No.: US 9,468,829 B2
(45) Date of Patent: Oct. 18, 2016

(54) SPORT SWING TRAINING APPARATUS AND SWING SYSTEM

(71) Applicant: Francis Jarvis, San Diego, CA (US)

(72) Inventor: Francis Jarvis, San Diego, CA (US)

( * ) Notice: Subject to any disclaimer, the term of this patent is extended or adjusted under 35 U.S.C. 154(b) by 0 days.

(21) Appl. No.: 14/806,666

(22) Filed: Jul. 23, 2015

(65) Prior Publication Data

US 2016/0023077 A1 Jan. 28, 2016

Related U.S. Application Data

(60) Provisional application No. 62/029,461, filed on Jul. 26, 2014.

(51) Int. Cl.

| | |
|---|---|
| ***A63B 69/00*** | (2006.01) |
| ***A63B 69/36*** | (2006.01) |
| ***A63B 15/00*** | (2006.01) |
| *A63B 71/02* | (2006.01) |
| *A63B 71/06* | (2006.01) |

(52) U.S. Cl.

CPC ..... *A63B 69/0002* (2013.01); *A63B 15/00* (2013.01); *A63B 69/3632* (2013.01); *A63B 69/3641* (2013.01); *A63B 69/0071* (2013.01); *A63B 69/0075* (2013.01); *A63B 69/0084* (2013.01); *A63B 71/023* (2013.01); *A63B 2069/0008* (2013.01); *A63B 2071/0694* (2013.01); *A63B 2102/02* (2015.10); *A63B 2102/182* (2015.10)

(58) Field of Classification Search

CPC ..... A63B 69/0084; A63B 69/0091; A63B 69/0002; A63B 2208/12; A63B 69/0079; A63B 69/38; A63B 2069/0008; A63B 2069/0006; A63B 69/3608

USPC ..... 473/428, 422–427, 451, 453, 458, 464

See application file for complete search history.

(56) References Cited

U.S. PATENT DOCUMENTS

| | | | | | |
|---|---|---|---|---|---|
| 266,062 | A * | 10/1882 | Spencer | A62B 1/20 | 182/49 |
| 278,768 | A * | 6/1883 | Bowman | A62B 1/20 | 182/49 |
| 279,175 | A * | 6/1883 | Meyer | A62B 1/20 | 182/49 |
| 1,522,714 | A * | 1/1925 | Dietze | A63F 7/0608 | 473/564 |
| 2,985,452 | A * | 5/1961 | Trippet | A63B 69/0002 | 473/453 |
| 2,988,846 | A * | 6/1961 | Samuel | A63H 1/32 | 446/253 |
| 3,011,784 | A * | 12/1961 | Segretto | A63B 69/0079 | 473/423 |
| 3,386,733 | A * | 6/1968 | Russo | A63B 69/0002 | 473/453 |
| 3,475,026 | A * | 10/1969 | Cooper | A63B 69/0002 | 473/426 |
| 3,550,937 | A * | 12/1970 | Patterson | A63B 69/0071 | 473/428 |
| 3,558,134 | A * | 1/1971 | Hoitsma | A63B 69/0075 | 473/428 |
| 3,937,464 | A * | 2/1976 | Zalewski | A63B 69/0091 | 473/428 |
| 3,940,131 | A * | 2/1976 | St. Claire, Jr. | A63B 69/0002 | 473/417 |
| 4,451,036 | A * | 5/1984 | Sinclair | A63B 69/0002 | 473/453 |
| 4,516,771 | A * | 5/1985 | Nau | A63B 69/0002 | 473/453 |

(Continued)

*Primary Examiner* — Mitra Aryanpour

(74) *Attorney, Agent, or Firm* — Garrett James O'Sullivan; Timothy Marc Shropshire; MU Patents

(57) ABSTRACT

Generally provided herein are devices to assist swing training in various sports. In some specific embodiments, the device is a baseball/softball, tennis and/or golf swing training system.

9 Claims, 11 Drawing Sheets

(56) References Cited

U.S. PATENT DOCUMENTS 4,577,863 A * 3/1986 Ito ..... A63B 69/0002 434/247
4,655,452 A * 4/1987 Huerstel ..... A63B 69/0002 473/453
4,664,375 A * 5/1987 Tetreault ..... A63B 69/0079 473/429
4,886,267 A * 12/1989 Licciardi ..... A63B 69/0075 473/417
4,944,513 A * 7/1990 Zentner ..... A63B 69/0084 473/428
5,029,852 A * 7/1991 Gilfillan ..... A63B 69/0002 473/417
5,087,039 A * 2/1992 Laseke ..... A63B 69/0002 473/417
5,226,645 A * 7/1993 Stewart ..... A63B 69/0002 473/453
5,322,276 A * 6/1994 Hardison, Jr. ..... A63B 69/3644 473/417
5,340,101 A * 8/1994 Lawson ..... A63B 69/0084 473/426
5,435,545 A * 7/1995 Marotta ..... A63B 69/0091 473/417
5,478,070 A * 12/1995 Morrison ..... A63B 69/0075 473/419
5,595,384 A * 1/1997 Hardison, Jr. ..... A63B 69/3644 473/417
5,642,880 A * 7/1997 Wiseman ..... A63B 69/0002 473/417
5,651,413 A * 7/1997 Williams ..... B22D 11/0665 164/121
5,951,413 A * 9/1999 Guerriero ..... A63B 69/0091 473/417
6,033,323 A * 3/2000 McCown ..... A63B 69/0088 473/423
6,042,491 A * 3/2000 Dixon, Jr. ..... A63B 69/0002 473/423
6,435,990 B1 * 8/2002 Bradley ..... A63B 69/0002 473/422
6,514,161 B1 * 2/2003 Minniear ..... A63B 69/0002 473/423
6,579,195 B2 * 6/2003 Lamb ..... A63B 69/0002 473/417
6,716,119 B1 * 4/2004 Weisz ..... A63B 69/0084 473/423
6,976,926 B2 * 12/2005 LaPointe ..... A63B 69/0084 473/422
7,033,290 B1 * 4/2006 Coldren ..... A63B 69/0002 473/422
7,300,365 B2 * 11/2007 Taylor ..... A63B 69/0057 473/422
7,662,052 B1 * 2/2010 Vidrine ..... A63B 69/0002 473/417
7,819,763 B2 * 10/2010 Campbell ..... A63B 69/0002 473/422
7,955,196 B2 * 6/2011 Constant ..... A63B 69/0002 473/422
8,088,027 B2 * 1/2012 Torch ..... A63B 69/0002 473/453
8,202,204 B2 * 6/2012 Celone ..... A63B 21/0088 473/228
8,556,753 B1 * 10/2013 Dixon, Jr. ..... A63B 69/0002 473/417
9,114,298 B2 * 8/2015 Ruggiero ..... A63B 69/206 482/83
2004/0033848 A1 * 2/2004 Bragg ..... A63B 69/0002 473/423
2011/0070978 A1 * 3/2011 Chandless ..... A63B 43/007 473/423
2014/0274480 A1 * 9/2014 Chandless ..... A63B 69/0079 473/423
2016/0023077 A1 * 1/2016 Jarvis ..... A63B 69/0002 473/424

* cited by examiner

SPORT SWING TRAINING APPARATUS AND SWING SYSTEM

CROSS-REFERENCE TO RELATED APPLICATION

This application claims the priority of U.S. Provisional Application No. 62/029,461, filed on Jul. 26, 2014, the disclosure of which is incorporated herein by reference for all purposes.

TECHNICAL FIELD OF THE INVENTION

The present disclosure generally relates to sport swing training devices. In specific embodiments, it relates to a baseball/softball, tennis and/or golf swing training system.

BACKGROUND ART OF THE INVENTION

Hitting a baseball/softball may be one of the most difficult skills to master. There are many different opinions as to the best way to swing the bat to give hitters the best chance of making solid contact with a ball. Three of the most common approaches to swinging a bat at a pitched ball include: (1) hitting the ball with a downward bat path relative to the ground, which is thought to give the ball a backspin causing the ball to rise and travel a greater distance; (2) hitting the ball with a level swing, meaning that the bat is traveling parallel to the ground when the bat strikes the ball; and (3) hitting the ball with a slight uppercut, matching the bat's path to that of the pitched ball.

Traditionally, the most common method of practicing this skill is to have a coach watch, while a batter either (a) hits a ball off of a tee or other similar device; (b) hits a ball while someone slowly tosses it underhand to him (soft toss); or (c) hits live pitching from a coach or from balls thrown from a pitching machine. After the batter hits the ball, the coach offers advice on how the hatter can improve his swing.

These training methods, as well as others, have been preferred and there have been many attempts to make the practice easier, more fun, and more productive, without having to wear someone's arm out by throwing batting practice and/or spending time picking up balls after they have been hit.

Previous attempts to accomplish this include the use of a device that gives the hitter a guide to help him take his bat to the ball as it sits at various points in the strike zone. Some of these devices guide the hitter's bat to the ball on a path that is at a downward angle while others guide it parallel to the ground or at an upward angle.

For example, U.S. Pat. No. 2,985,452 discloses two curved metal bars mounted parallel to the ground that a batter is to swing his bat through and U.S. Pat. No. 5,226,645 describes a pair of wheels rotatably mounted in a vertical plane.

U.S. Pat. No. 3,386,733 discloses two pliable rubber arms placed opposite of each other in a vertical position. In this device, the arms spread apart to allow a baseball to be placed between them, allowing the ball in space to be struck by a bat at any angle.

U.S. Pat. No. 3,475,026 discloses a ball suspended in the air by two strings that are connected to a frame in such a way that when the ball is struck, the strings flex and bring the ball back to its original position. This is another device that holds a ball in space with no guide for the bat.

U.S. Pat. No. 3,937,464 describes a device to teach a swing that is parallel to the ground whereby the ball is mounted to a spring loaded track so when the ball is struck, it will return to its original position.

U.S. Pat. No. 3,940,131 describes a device where a ball s mounted to two bars that are parallel to the ground, which tells the batter if his swing is parallel to the ground.

U.S. Pat. No. 4,451,036 describes a device where the batter swings his bat parallee to the ground through two bars with tabs hanging off of them.

U.S. Pat. No. 4,516,771 describes two parallel bars mounted to a pole in front of the batter. In this device, the bars are parallel to the ground and the bat is to be swung between them forcing the batter to have his bat level as it crosses the plate.

U.S. Pat. No. 4,577,863 discloses a number of lasers mounted in a plate on the ground. These lasers measure the trajectory and speed of the bat as it is swung across the plate. This device is not easily operated by a typicalhitter.

U.S. Pat. No. 4,655,452 discloses a device that has two wheels rotatably mounted in a vertical plane that would allow the batter to swing his bat through them. This arrangement gives the batter a target at which to aim his bat as well as a resistive force to drive his bat through but does not teach a bat path.

U.S. Pat. No. 4,664,375 discloses a device having a ball suspended from a stationary-arm on a flexible line without any guide for the bat.

U.S. Pat. No. 4,886,267 discloses a batting tee and two poles that act as swing guides to tell the batter if his hands are remaining close to his body during his swing but does not incorporate the ball path as a guide. U.S. Pat. No. 8,556,753 describes a swing fide that attaches to a traditional tee. U.S. Pat. No. 5,029,852, describes a bat swing guide that includes an arcuate guide member, a horizontal guide, and a base, but fails to use the pitched ball path as a method for teaching.

U.S. Pat. No. 5,087,039 describes a pair of parallel bars mounted to a base. These bars allow a bat to pass between them. At the end opposite where the bat enters the bars, there is a ball holder similar to a tee with a guide for the bat to strike the ball.

U.S. Pat. No. 5,322,276 and U.S. Pat. No. 5,595,384 describe a batting tee with an arcuate guide attached to it to aid the batter in taking his bat to the ball and U.S. Pat. No. 5,435,545 discloses a batting tee that has guides showing the limits of the strike zone allowing the user to position the ball in the strike zone.

U.S. Pat. No. 5,478,070 describes a batting tee with spring loaded guides to help guide the bat to the ball. U.S. Pat. No. 5,642,880 describes a method for teaching the batter how to position himself in the batter's box. U.S. Pat. No. 5,951,413 describes a tee with a guide for the bat that teaches a downward swing to the ball.

U.S. Pat. No. 6,435,990 describes a pair of horizontal bars mounted to a base with a ball held at the end opposite where the bat enters. U.S. Pat. No. 6,579,195 describes a frame that is placed around the batter to help the hitter to start his swing correctly. U.S. Pat. No. 7,300,365 describes two boards on hinges with an opening between them to act as a target for the batter to aim at.

U.S. Pat. No. 7,662,052 describes a tee with a bat guide to the ball. On this tee, the ball is attached to a string so it does not need to be reloaded. U.S. Pat. No. 7,955,196 describes a frame that is placed around a traditional batting tee. The device holds two strings above the ball on the tee to give the hitter a visual cue as to the plane of his bat path. U.S. Pat. No. 8,088,027 describes a bat guide that is placed around the batter to help guide his bat during his swing.

U.S. Pat. No. 7,819,763 discloses a device that acts as a guide for the batter to swing his bat through. This is the only device that suggests an upward path for the swing to match that of a pitched ball. Although the thinking is the same as the present invention as far as how the bat should strike the ball, the device fails to give the path of the pitched ball as a guide for the hitter, and it is not easily moved to different positions.

U.S. Pat. No. 6,033,323 and U.S. Pat. No. 6,042,491 disclose a ball mounted on two strings that have an anchor at one end and handles on the other end. As the handles are pulled apart, the ball is propelled towards the anchored end. At the anchored end is a batter; when the ball comes towards him, simulating a pitch, he hits it with a bat, returning it back up the lines to the pitcher. While this may be a fun activity, it teaches more about timing the pitch than actually how to bring the hitter's bat to the ball.

The problem with the devices available until now is that they all deal with the striking of the ball as it sits in a specific spot in front of the batter. None of these methods give the batter and the coach the path of the ball as it would be seen in a live game situation. The only way to practice hitting a game-speed pitch is to use live pitching. The problem with live pitching is that it is in full speed, which prevents a coach or batter to work on the individual components of the swing, namely, the path of the bat vs. the path of the ball.

In order to become a good hitter, it is it imperative that the batter be able to develop good musclememory by executing a slow, accurate swing. The prior art that does provide a path to act as a guide for the hitter's bat gives the guide for the bat to the ball as it sits on a tee, with nothing to show the trajectory of the pitched ball. The trajectory of the incoming pitch is critical in determining whether or not the hitter's bat path is matched to the path of the incoming pitch.

Almost all of the prior art subscribes to the notion that it is best to swing down or parallel to the ground when trying to hit the ball, while others, like the traditional batting-tee, only suspend a ball in space and allow the batter to take his bat to the ball however he chooses, leaving the ball's trajectory to the batter's imagination.

Consequently, a need still exists for a solution to the aforementioned problems. The present disclosure describes a training aid that is inexpensive, lightweight, quick to set up, can easily be carried in a player's bag with his other gear, and offers a player and coach the ability to see the path of the pitched ball from the release point of the pitcher, all the way to the catcher for every possible pitch location. This, in turn, allows bath the coach and the batter the ability to see the relationship of the swinging bat to the pitched ball throughout the entire swing.

DISCLOSURE OF THE INVENTION

The present invention seeks to satisfy the aforementioned need by providing a device that is inexpensive, easy to manufacture, transport, and set up, and ultimately, very effective when it comes to improving a batter's skills. Described herein is a design that does not require users to have any special skills and is unlike anything that has ever been used to practice hitting pitched baseballs or softballs.

The device provides a game speed, visual ball path (pitch) from the release point of the pitcher to the catcher's glove. Within this ball path is an area known as the contact zone—the area over the plate where the hitter would make contact with the pitched ball. The contact zone is defined by the swing trainer and therefore allows the coach and hitter to know when the hitter's bat path is matched to the path of the pitched ball while it is traveling through the contact zone. The hitter may swing at full speed or as slow as he wishes, which allows both him and his coach to see the relationship between his bat path and the path of the pitched ball at every point in the process.

In various embodiments, the bat path matches the ball path, in the opposite direction, while traveling through the contact zone. This gives the hitter the best chance of making solid contact with the ball. The device described herein is a valuable tool for bath the beginner, as a way to train his muscles for a proper swing, as well as a swing tune-up for the advanced hitter. The apparatus may be used either indoors or outdoors and can be set up in seconds.

In various embodiments described herein the batting swing trainer includes an anchor or attachment means that would allow the apparatus to be attached to a pole or other suitable structure at the proper height; a first line, at the first end attached to said anchor, and the second end attached to two other equal length lines; two lines of equal length attached to the second end of the first line, which essentially splits the first line into two separate lines; two line spreaders attached to each of the two equal length lines at opposite ends, holding them apart at a set distance thus creating a long, thin rectangle out of the two lines (this is what defines the contact zone); and a handle for a coach to pull the lines tight against the anchor, giving the apparatus its shape.

In specific embodiments, the training device further comprises one or more lightweight, hollow balls mounted on said first line. In these embodiments, the balls are a hollow, plastic, spherical shape resembling either a baseball or a softball. In specific embodiments, the balls have two holes drilled through opposite sides allowing the first line to pass through the center of them. In various embodiments, the holes are of a size that will allow the balls to be moved along the line but they will have enough interference with the line that they will stay in place when there is no pressure on them.

In other embodiments, the training device further comprises one or more ball markers on the line. In these embodiments, the one or more ball markers are placed on the top or bottom line as desired and can be moved along the line. In these embodiments, the ball markers tell the hitter where contact with the ball should be made.

In yet other embodiments, the training device further comprises a modified bat that has both an irregular shaped handle and a rod that goes through the bat at a perpendicular angle to the longitudinal axis of the bat, just below the "sweet spot" area where it is most preferred to contact the ball.

One embodiment of the swing trainer is set up for use by two people. In this embodiment, for the purposes of clarity we will define them as the coach "C" and the hitter "H." In this embodiment of the invention, the device is first attached to a steady object, including but not limited to a pole, a tree, or other sufficiently rigid structure at a height that matches that of a pitch at that distance from the plate. As understood in the art, the height is readily determined by the release point of the pitcher and will therefore, differ depending on a variety of factors, including but not limited to the sport the hitter is training for (i.e., softball vs. baseball) and the age, height and/or weight of the hitter.

In this embodiment, the coach then positions himself behind a home plate where a catcher would normally set up, and pulls the device tight against the steady object. This forms a ball path that defines the contact zone from the release point of the pitcher to the catcher's glove. Accordingly, the coach has the ability to easily position the device anywhere in the strike zone, allowing the hitter to work on different pitches without having to make any mechanical adjustments to the device.

The hitter can see the exact path of the pitched ball from the release point of the pitcher all the way to the catcher's glove. When he swings and his bat travels through the rectangular opening without hitting any of the lines, he knows that his swing is matched to the path of the ball perfectly. Of course, if the hitter's bat hits the lines or completely misses them, he will immediately know that his bat path is not matched to the path of the ball. From the coach's position he can both see the path of the bat as it passes through the contact zone as well as feel through the handle, when the bat contacts the lines. Accordingly, the coach can provide accurate feedback to the hitter enabling the hitter to make appropriate adjustments to improve his swing.

In various embodiments, the bat is any standard bat. In specific embodiments, the bat has two distinct modifications from a traditional one. In one embodiment, the bat has an irregular shaped handle to help the batter to properly align his hands while holding the bat. In another embodiment, the bat has a stiff rod approximately 1 inch in diameter that protrudes 3 inches on each side from the bottom of the area on the bat where is it most preferred to make contact with the ball (the "sweet spot") at an angle that is perpendicular to the sides of the bat.

In various embodiments, the attachment means of the first line comprises a clip, shackle, carabineer, or any other similar means that perform the same function. In these embodiments, the attachment means allow the device to easily be attached to a chain link fence or other similar structure.

In alternative embodiments, a pair of D-rings mounted to the line are used to act as a buckle. This embodiment allows the device to be attached to a pole or tree without slipping down, which would change the height and therefore affect the angle of the swing trainer.

These and other features and advantages of the present invention will become apparent to those skilled in the art upon reading the following detailed description when taken in conjunction with the drawings wherein there is shown and described an illustrative embodiment of the invention.

EXEMPLARY TERMS

As used herein, the terms "comprising," "including," "has," "having," "contains," "containing," "such as" or any other variation thereof are used in their open, non-limiting sense, such that a process, method, article, or apparatus that comprises, has, includes, or contains a list of elements does not include only those elements but may include other elements not expressly listed or inherent to such process, method, article, or apparatus.

The terms "a" and "an" are defined as one or more unless explicitly stated otherwise herein.

An element proceeded by "comprises . . . a," "has . . . a," "includes . . . a," or "contains . . . a" does not, without more constraints, preclude the existence of additional identical elements in the process, method, article, or apparatus that comprises, has, includes, or contains the element.

The terms "substantially," "essentially," "approximately," "about," or any other version thereof are defined as being close to as understood by one of ordinary skill in the art, and in one non-limiting embodiment the term is defined to be within 10%, in another embodiment within 5%, in another embodiment within 1% and in another embodiment within 0.5%.

The term "coupled" as used herein is defined as connected, although not necessarily directly and not necessarily mechanically. A device or structure that is "configured" in a certain way is configured in at least that way, but may also be configured in ways that are not listed.

The terms "batter" and "hitter" are used interchangeably throughout the specification, claims and figures.

As used herein, the term "line" is intended as a generic term to describe a rope, webbing, string, and materials of similar nature.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
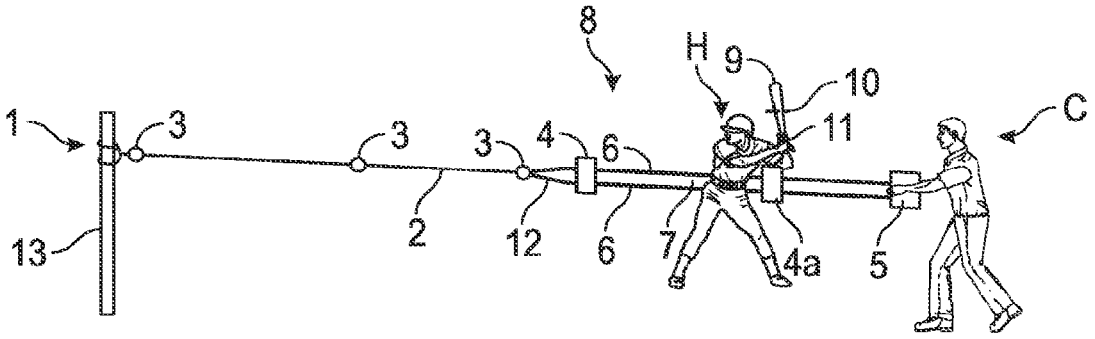
FIG. 1 exemplifies a side elevation view of a batting swing training device according to some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help improve understanding of embodiments of the present invention.

The apparatus and method components have been represented where appropriate by conventional symbols in the drawings, showing only those specific details that are pertinent to understanding the embodiments of the present invention. This is to avoid obscuring the disclosure with details that will be readily apparent to those of ordinary skill in the art having the benefit of the description herein.

DETAILED DESCRIPTION OF ILLUSTRATIVE EMBODIMENTS

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Embodiments of the present disclosure describe a sport swing training apparatus that can be used in training the swing of a bat by a batter in baseball or softball, the swing of a golf club by a golfer, or the swing of a tennis racquet by a tennis player.

In some embodiments directed to the swing training apparatus for a batter swinging a baseball/softball bat, the apparatus is shown in FIG. 1. This is a side elevation view of a batting swing training device 8 in accordance to some embodiments. In a preferred embodiment, the batting swing training device 8 includes a fastener 1, a first line 2 with a plurality of balls 3 mounted and spaced evenly along its length, a set of equal length lines 6 (a top line and a bottom line), at one end attached to the first line 2 at a joint 12 and at the other end, attached to a handle 5. Mounted between these two equal length lines 6, is a set of line spreaders 4 and 4*a* that are the same size and shape.

The first line spreader 4 is attached approximately 6 inches from the joint 12, while the second line spreader 4*a* is attached to the lines approximately 30 inches from the handle 5, which is located at the end of the lines 6. The rectangular area created between the two line spreaders is the contact zone 7. This is the area that the bat travels through, indicating the accuracy of the swing.

The modified bat 9 includes an irregular shaped handle 11 and a rigid rod 10 that goes through the bat just below the sweet spot. This rod protrudes from the sides of the bat at a length that is substantially greater than the distance between the top and bottom lines 6 at a perpendicular angle to the longitudinal axis of the bat (see, e.g. FIG. 6A, FIG. 6B, FIG. 6C and FIG. 7). The sweet spot is the area on a bat where it is most preferred to contact the ball and generally relates to the top third of a bat.

Figure 2:
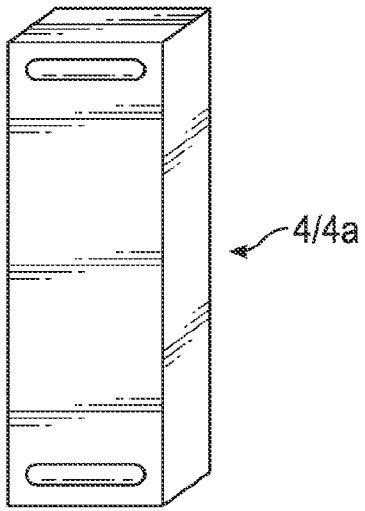
FIG. 2 illustrates rigid line spreaders of a batting swing training device according to some embodiments of the invention.

FIG. 2 shows rigid line spreaders 4 and 4*a* of a batting swing training device according to some embodiments. The line spreaders 4 and 4*a* are substantially of a rectangular block shape and can be made of plastic, although skilled artisans will realize that the shape and material makeup may be substituted so long as it performs the same function. The basic function of these line spreaders is to hold the lines 6 apart at a set distance. The two line spreaders 4 and 4*a*, along with the two lines 6, form the boundaries of a long rectangle known as the contact zone. To accomplish this, there are two passages cut into the line spreaders at either end that allow the lines to pass through then. These spreaders are held in place along the line by a pin, rod, screw, cam lock, or any other device that performs the same function.

Figure 3:
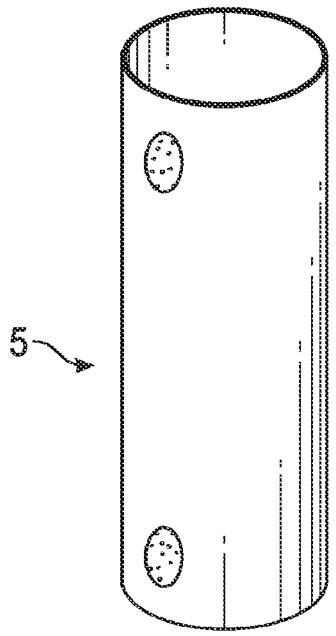
FIG. 3 exemplifies the handle of a batting swing training device according to some embodiments of the invention.

FIG. 3 shows the handle 5 of the device according to some embodiments. In specific embodiments, the handle 5 is preferably comprised of a substantially plastic material, though it may be comprised of any other suitable material. The handle 5 has a substantially rod shaped configuration with openings on either end to allow attachment to the lines 6 that make up the contact zone, though it may have any other suitable configuration that would perform the same function. The handle also has a mechanism for holding its position on the lines. In various embodiments, the holding mechanism is in the form of a pin, screw, rod, or any other means that performs the same function.

Figure 4:
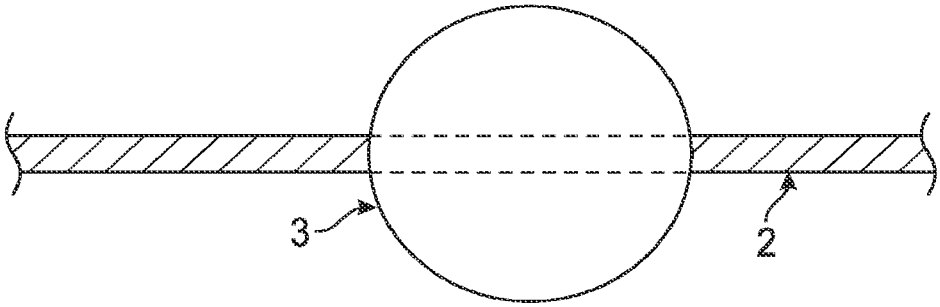
FIG. 4 illustrates a hollow, lightweight ball attached along the line of a device according to some embodiments of the invention.

FIG. 4 shows how the balls 3 are attached along the line 2 of the device according to some embodiments. In specific embodiments, the balls are substantially made of a hollow, lightweight plastic, and are sized to represent a baseball or softball. The materials, ball size, and mounting methods can be any known in the art. The balls are a visual aid to the hitter and coach and, as such, may be made of any suitable material and sized without changing their function. In some embodiments, the balls have two holes on opposite sides and are of a size that would allow for an interference fit between the line 2 going through them and the sides of the holes. This fit in these specific embodiments allows the balls to be repositioned easily with minimal pressure, without allowing them to freely move and change position randomly. The line 2 is substantially made up of the same material as the other lines used in the device. A skilled artisan understands that many different materials can be used, including but not limited to cotton, polypropylene, polyethylene, or nylon, in the form of rope, string, or webbing.

Figure 5:
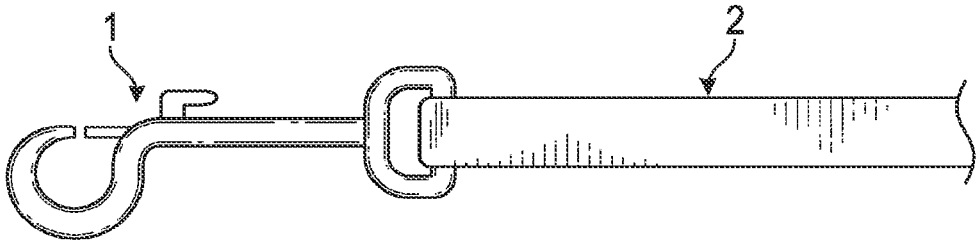
FIG. 5 shows an attachment mechanism for the device along with the first line according to some embodiments of the invention.

FIG. 5 illustrates one type of attachment mechanism 1 for the device along with the first line 2 of a device according to some embodiments. In one specific embodiment, the attachment mechanism may be a clip to fasten the swing trainer's first line 2 to a suitable anchor. In alternative embodiments, this clip may be substituted by any similar device that would perform the same function; for example, a shackle or a carabineer could be used. In still other embodiments a set of D-rings may be added to the line to act as a buckle for fastening the device securely to a pole to eliminate the worry of it slipping down the pole and therefore changing the angle of the device as it relates to the ball path.

Figure 6A:
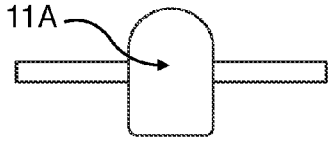
FIG. 6A, FIG. 6B and FIG. 6C illustrate exemplary cross sectional views of irregular bat handles and a protruding rod of the device according to some embodiments of the invention.
Figure 6B:
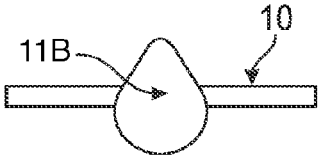
Figure 6C:
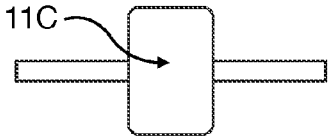

FIGS. 6A-C illustrate cross sectional views of exemplary irregular bat handles 11A-11C and the protruding rod 10 of a device according to some embodiments. FIG. 6B is a cross sectional view of an exemplary modified bat from the bottom, just above the knob. This view shows the general shape of the bat's handle as well as a view of the protruding rod and its angle, according to this embodiment.

Figure 7:
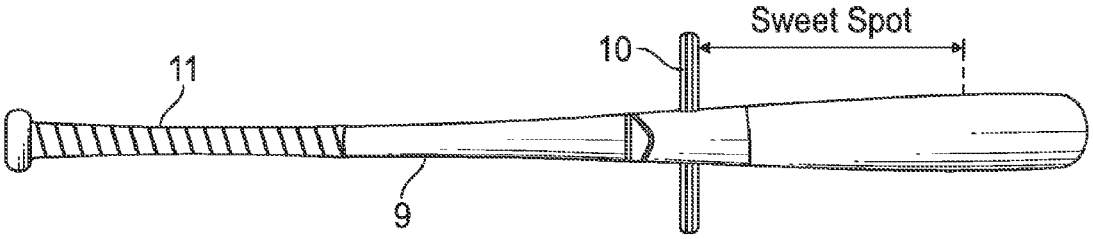
FIG. 7 exemplifies a modified bat with the rod protruding from the sliders according to some embodiments of the invention.

FIG. 7 illustrates a modified bat with the rod 10 protruding from the sides according to some embodiments. This is a side view of the bat and also depicts the relative position of the protruding rod 10 and the sweet spot of the bat.

Figure 8:
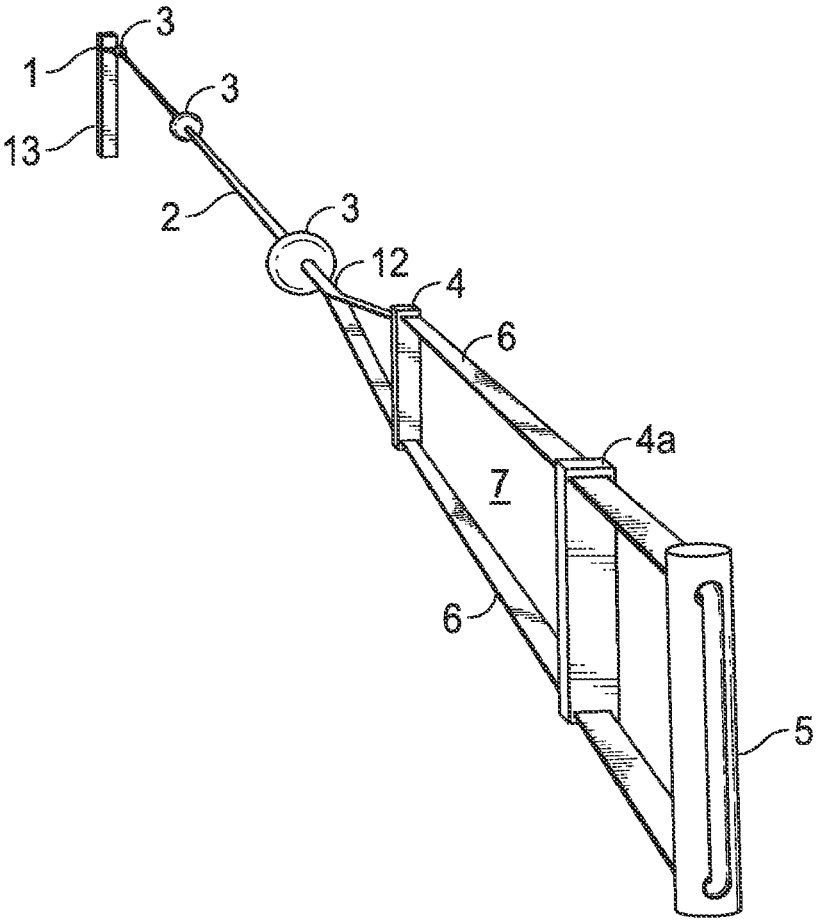
FIG. 8 illustrates a rear view of a batting swing training device according to some embodiments of the invention.

FIG. 8 illustrates a rear view of a device according to some embodiments. This is a rear, side view of the swing trainer as it would look when pulled tight against, the anchor 13. This view demonstrates a ball path and how the ball path is transformed into a contact zone 7 while still maintaining the ball's original path.

Figure 9:
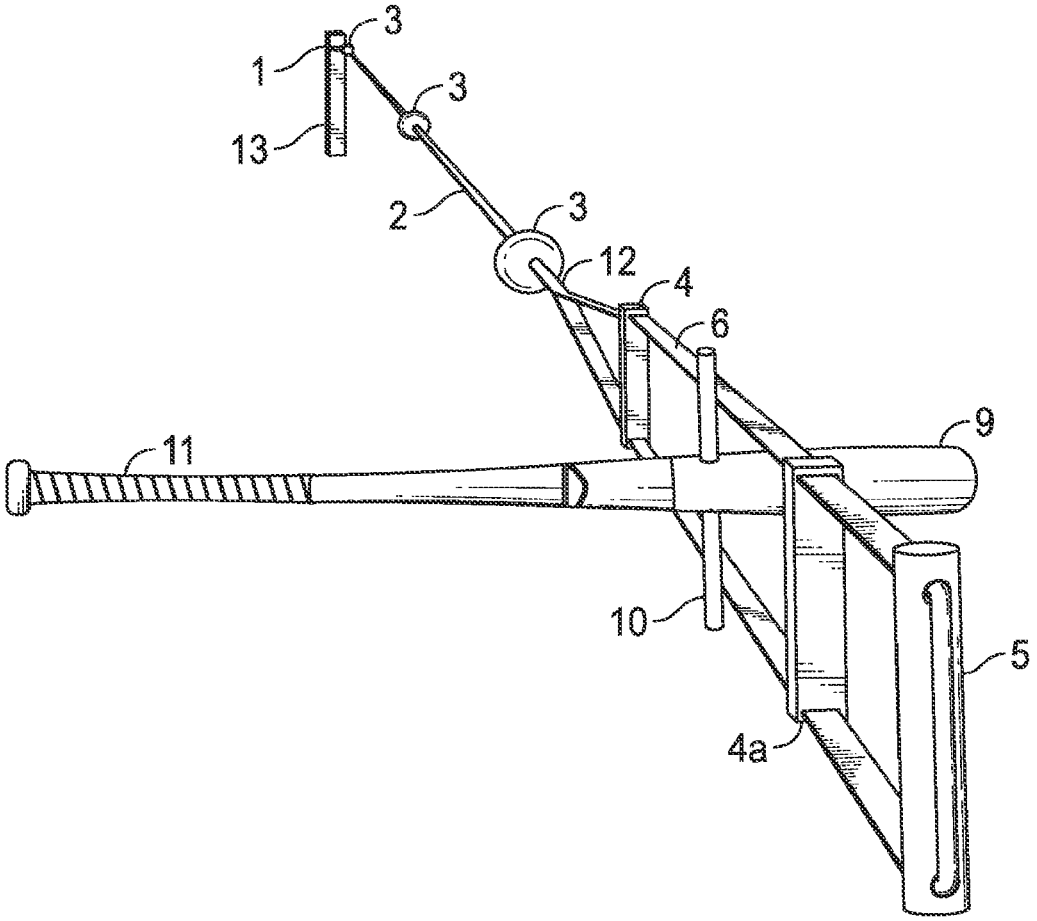
FIG. 9 illustrates a rear view of a modified bat inside the contact zone of the device according to some embodiments of the invention.

FIG. 9 shows a rear view of the modified bat 9 inside the contact zone 7 of a batting swing training device in accordance to some embodiments. This is the same view as FIG. 8 but illustrates how the modified bat 9 passes through the swing trainer's contact zone. This view also shows how the protruding rod 10 on the bat keeps the bat from traveling too deep into the ball path which would expose the bat's handle to the ball and potentially break the bat.

Figure 10A:
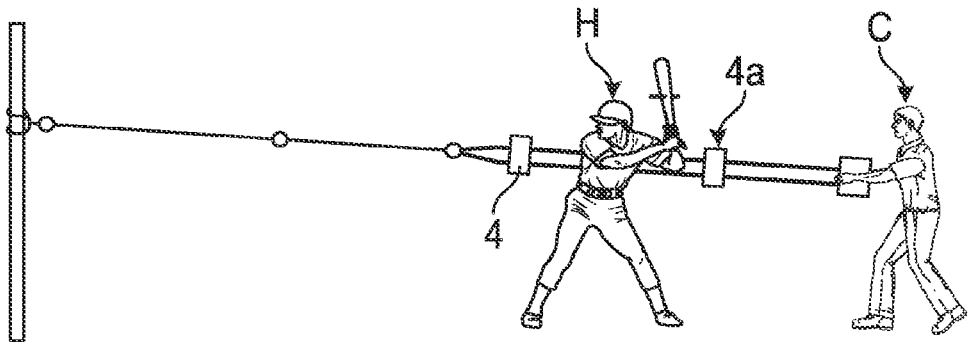
FIG. 10A, FIG. 10B and FIG. 10C illustrate a hitter (H) and a coach (C) using a device according to some embodiments of the invention.
Figure 10B:
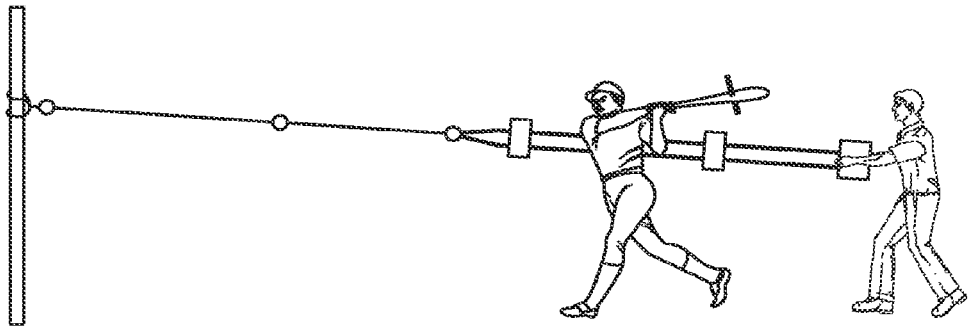
Figure 10C:
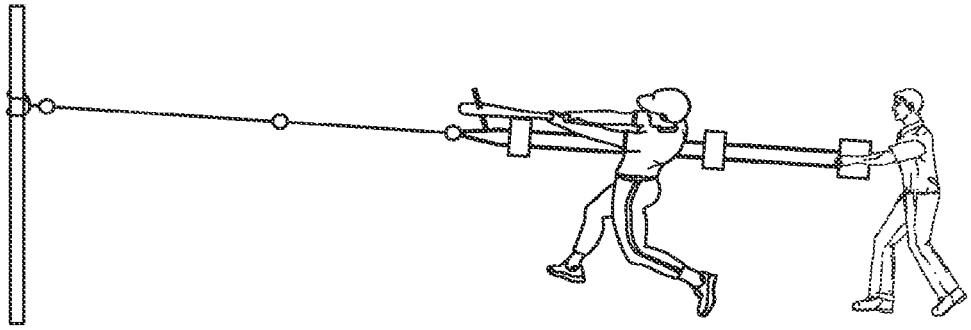

FIGS. 10A-C illustrate a hitter bat and a coach C using a device according to some embodiments. These three figures show how the hitter's bat moves through the device at different points during his swing. This figure also shows how the line spreader 4*a* keeps the swinging bat safely in front of the coach holding the device. If the batter is too far back, his bat will hit the line spreader 4*a*, stopping his swing.

Figure 11A:
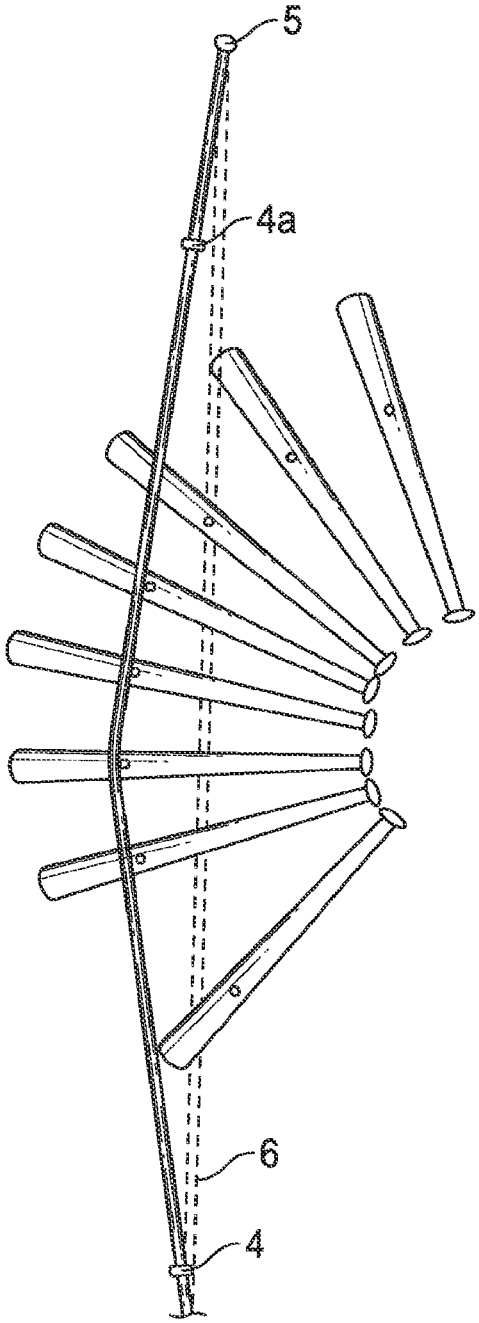
FIG. 11A and FIG. 11B illustrates how a protruding rod on the bat interfaces with the lines of a device according to some embodiments of the invention.
Figure 11B:
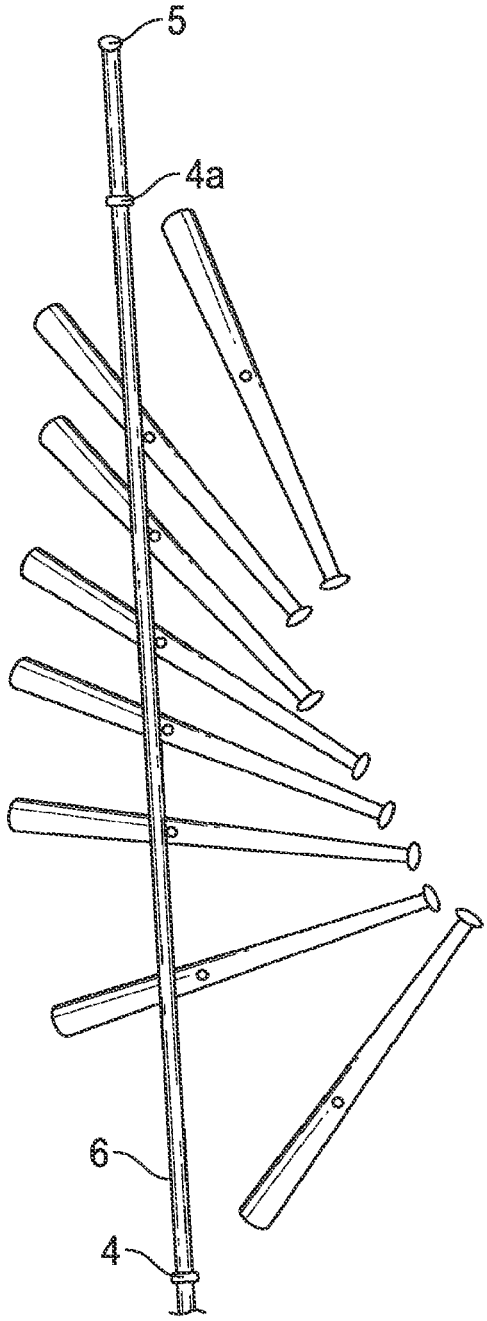

FIG. 11A and FIG. 11B shows a top view of the contact zone of the swing trainer. The left side shows abut that is traveling too far into the path of the ball thus exposing the handle to breakage. This demonstrates how the rod on the bat will contact the lines of the swing trainer and therefore notify both the coach and the hitter of this type of fault. While using the device, the coach is able to see the contact from his vantage point behind the plate as well as feel the contact through the swing trainer handle. The hitter is able to feel it through the bat handle and hear the sound from the contact between the lines and the rod. The right side of the figure shows a top view of the swing training device with the bat traveling on a correct path to keep the sweet spot of the bat exposed to contact with the ball throughout the entire contact zone.

Figure 12:
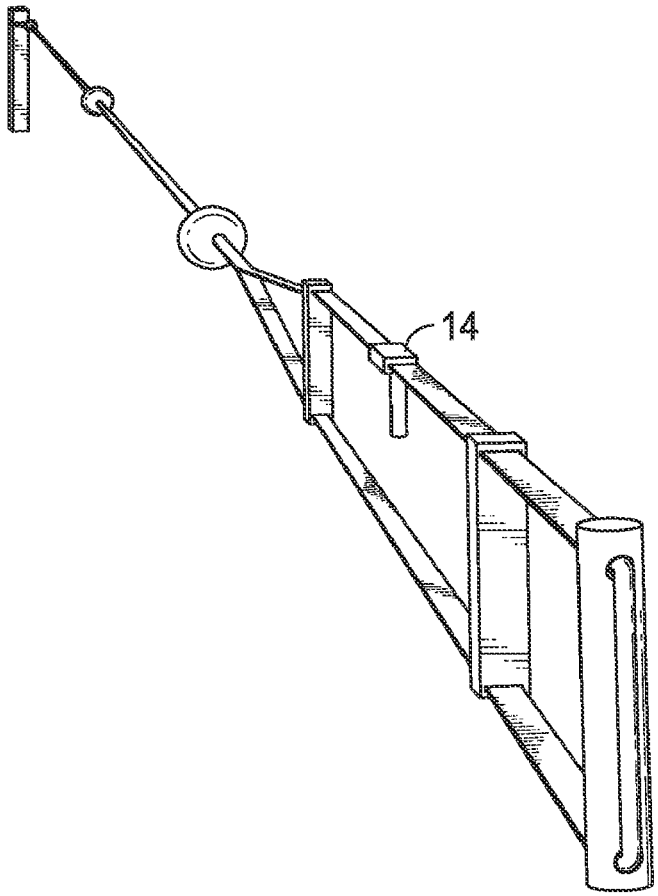
FIG. 12 illustrates a rear view of device with a moveable marker to aid the hitter in visualizing where contact with the hall should be made according to some embodiments of the invention.

FIG. 12 shows an embodiment that includes a marker 14 that is capable of moving along the line of the contact zone. In various embodiments, the marker 14 is located along the top or bottom lines 6 of the contact zone 7. These markers are either permanently mounted or made able to move within the contact zone. These markers give the hitter an idea of where he should be making contact with a given pitch. Usually an inside pitch is hit in front of the plate and therefore the marker would be moved to that position, whereas an outside pitch is typically hit towards the back of the plate and the marker would be moved accordingly.

Figure 14:
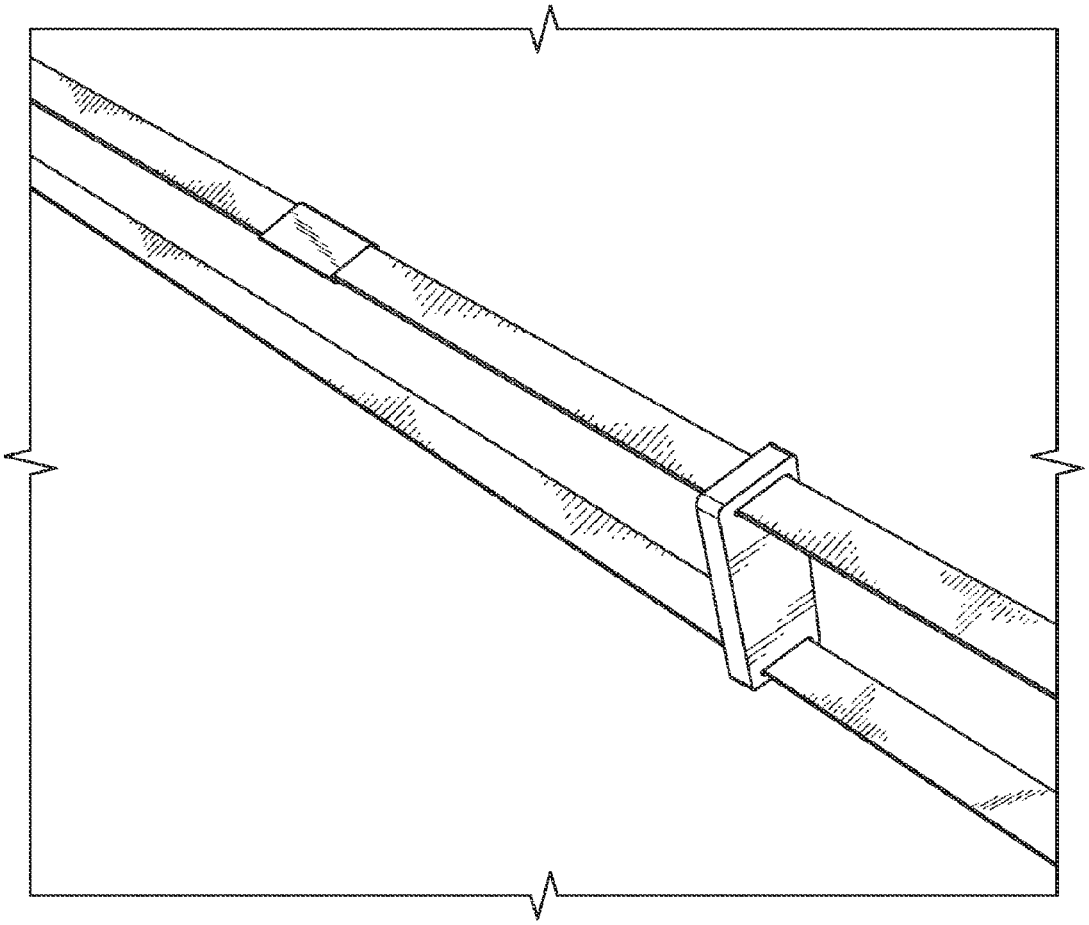
FIG. 14 and FIG. 15 illustrate the device that includes a ball marker on the line according to some embodiments of the invention. In this embodiment, the marker can be moved anywhere along the line and tells the hitter where the ball contact should be.
Figure 15:
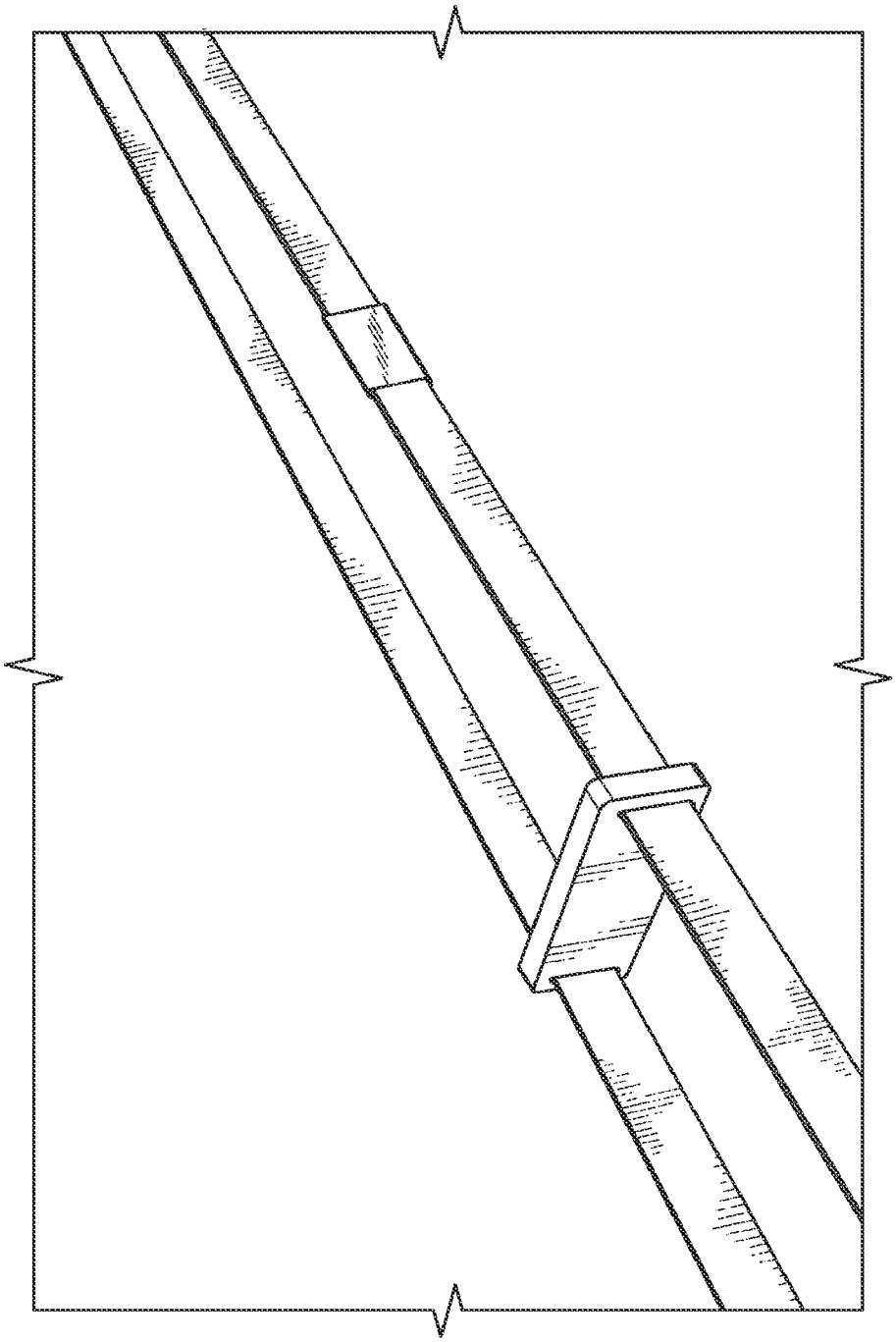

FIG. 14 and FIG. 15 illustrate an alternative embodiment of a device containing the marker described in FIG. 12.

Figure 13:
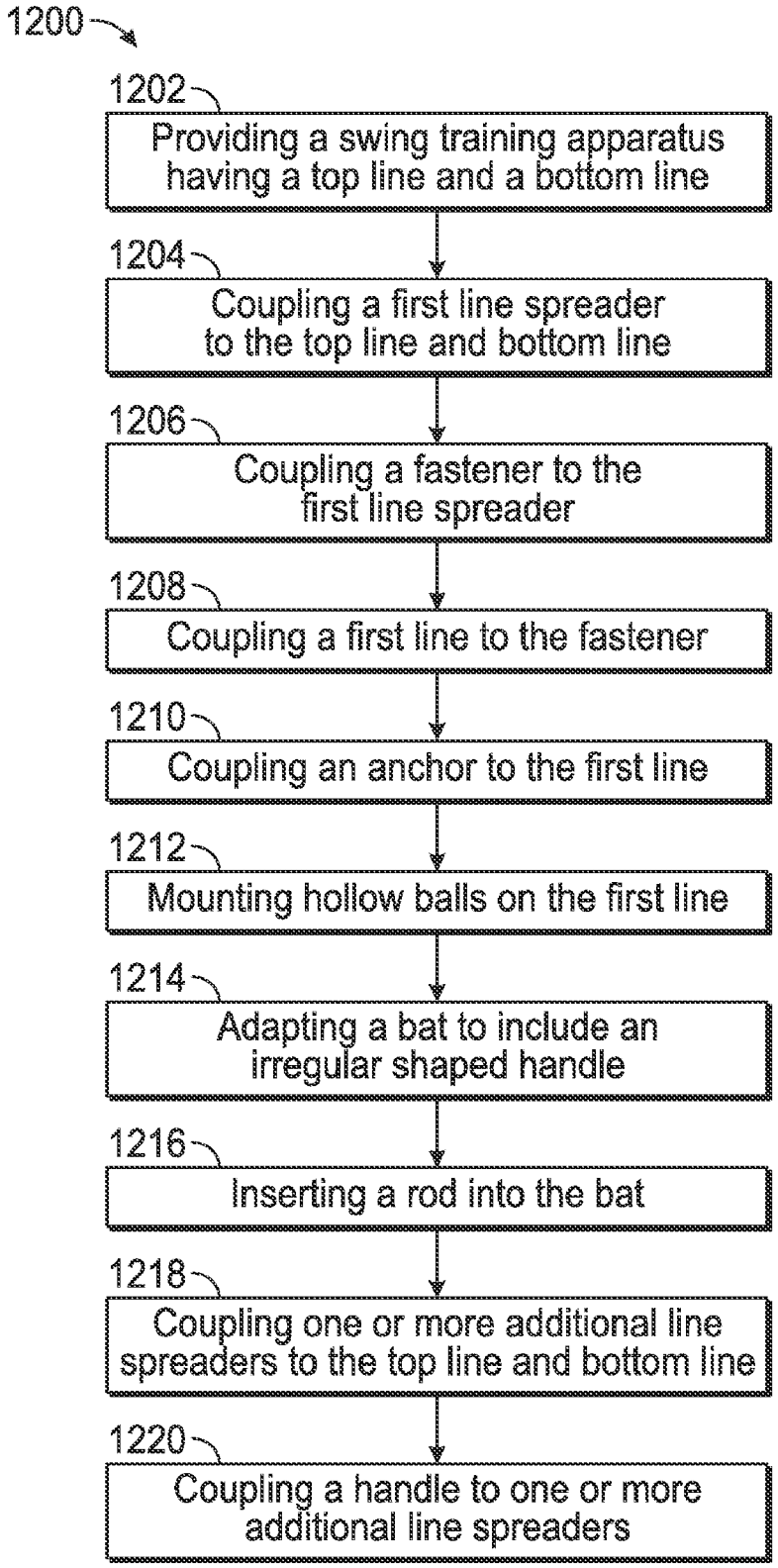
FIG. 13 is a flowchart of a method for training a swing according to some embodiments of the invention.

FIG. 13 is a flowchart of a method 1200 for training a swing in accordance to some embodiments. The method 1200 includes providing a swing training apparatus having a top line with a first end and a second end and a bottom line with a first end and second end, as shown in block 1202. Further, the method 1200 includes coupling a first line spreader to the first end of the top line and the first end of the bottom line, as shown in block 1204. In addition, the method 1200 includes coupling a fastener to the first line spreader, as shown in block 1206. Moreover, the method 1200 includes coupling a first line to the fastener wherein the first line includes a first end and a second end such that the second end of the first line is coupled to the fastener, as shown in block 1208. Further, the method 1200 includes coupling an anchor to the first end of the first line and the anchor adapted to be coupled to a rigid structure, as shown in block 1210.

In addition, the method 1200 includes mounting one or more hollow baseballs on the first line, as shown in block 1212. Moreover, the method 1200 includes adapting a baseball bat to include an irregular shaped handle, as shown in block 1214. Also, the method 1200 includes inserting a rod into the baseball bat such that the rod is located substantially near two-thirds up the length of the baseball bat from the irregular shaped handle, as shown in block 1216. The rod is perpendicular to the longitudinal axis of the baseball bat and the length of the rod is substantially more than a length between the top line and the bottom fine. Further, the method 1200 includes coupling one or more additional line spreaders to both the top line and bottom line, as show in block 1218. In addition, method 1200 includes coupling a handle to one of the one or more additional line spreaders, as shown in block 1220. Note, the spreader acts to help maintain the distance between the two lines; it is also used as a marker that allows the hitter to know if he has a long swing, as a marker for the back of the home plate, and a way to keep the swinging bat away from the person holding the handle (as described herein).

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

I claim:

1. A swing training device, comprising:

a. a top line having a first end and a second end and a bottom line having a first end and a second end;

b. a first spreader positioned between the top and bottom lines towards the first end, and wherein the first ends of the top and bottom lines are joined together at a joint;

c. a handle coupled at the second end between the top line and the bottom line;

d. a second line spreader coupled to the top and bottom lines between the first line spreader and the handle;

e. a first line having a first end and a second end, wherein the first end of the first line is coupled to the first end of the top and bottom lines at the joint;

f. an anchor coupled to the second end of the first line, wherein the anchor is adapted to be coupled to a support structure; and g. one or more balls slidably mounted on the first line forming a ball path thereon.

2. The device of claim 1, further comprising a bat having an irregular shaped handle; and a rod inserted into the bat such that the rod is located about two-thirds of the length of the bat from the bottom of the irregular shaped handle, wherein the rod is perpendicular to the longitudinal axis of the baseball bat.

3. The device of claim 2, wherein the length of the rod is substantially greater than a length between the top line and the bottom line, wherein the rod prevents the training bat from traveling too deep into the ball path when the bat is moving through the device at different points during the batter's swing.

4. The device of the claim 1, further comprising one or more additional spreaders coupled between the top line and bottom line.

5. The device of claim 1, further comprising a ball marker slidably positioned on either the top line or the bottom line.

6. A method for using a swing training device, comprising the steps of:

a. selecting a device having a top line having a first end and a second end and a bottom line having a first end and a second end;

b. coupling towards the first end of the top and bottom line a first line spreader;

c. joining the first ends of the top and bottom lines at a joint;

d. coupling at the second end between the top line and the bottom line a handle;

e. coupling a second line spreader to the top and bottom lines between the first line spreader and the handle;

f. coupling a fastener to the first line spreader;

g. coupling a first line to the fastener, wherein the first line includes a first end and a second end, wherein the first end of the first line is coupled to the fastener and the second end is coupled at the joint to the first end of the top and bottom lines;

h. coupling an anchor to the second end of the first line, wherein the anchor is adapted to be coupled to a support structure;

i. slidably mounting one or more balls on the first line forming a ball path thereon;

j. selecting a training bat having an irregular shaped handle and a rod inserted into the bat such that the rod is located at about two-thirds of the length of the bat from the bottom of the irregular shaped handle, wherein the rod is perpendicular to the longitudinal axis of the baseball bat; and wherein the rod prevents the training bat from traveling too deep into the ball path when the bat is moving through the device at different points during the batter's swing.

7. The method of claim 6, wherein a length of the rod is substantially greater than a length between the top line and the bottom line.

8. The method of the claim 6, further comprising coupling one or more additional line spreaders between the top line and the bottom line.

9. The method of claim 6, further comprising a ball marker slidably positioned on either the top or the bottom.

* * * * *